252-99 AU 166 EX
12/29/81 XR 4,308,158

United States Patent [19]
Gohla et al.

[11] 4,308,158
[45] Dec. 29, 1981

[54] DETERGENT AND CLEANING COMPOSITIONS CONTAINING POLYMERIC PHOSPHATE BUILDERS

[75] Inventors: Werner Gohla, Niederkassel; Klaus Hestermann; Joachim Kandler, both of Erftstadt; Horst-Dieter Wasel-Nielen, Hürth; Karl Merkenich, Rimbach, all of Fed. Rep. of Germany

[73] Assignee: Hoechst Aktiengesellschaft, Fed. Rep. of Germany

[21] Appl. No.: 36,403

[22] Filed: May 7, 1979

[30] Foreign Application Priority Data

May 11, 1978 [DE] Fed. Rep. of Germany ..... 2820554

[51] Int. Cl.[3] ..... C11D 3/065; C11D 7/16

[52] U.S. Cl. ..... 252/97; 252/98; 252/99; 252/109; 252/110; 252/135; 252/539; 252/540

[58] Field of Search ..... 252/135, 539, 99, 97, 252/98, 109, 110; 423/308, 312, 315, 316; 23/313 R

[56] References Cited

U.S. PATENT DOCUMENTS

| | | | |
|---|---|---|---|
| 2,568,110 | 9/1951 | Beiley et al. | 252/135 |
| 2,594,431 | 4/1952 | Harris et al. | 252/140 |
| 2,992,186 | 7/1961 | Hellsten | 252/135 |
| 3,015,540 | 1/1962 | Striplin et al. | 423/316 |
| 3,223,646 | 12/1965 | McKenna et al. | 252/135 |
| 3,321,406 | 5/1967 | Shen | 252/135 X |
| 3,403,974 | 10/1968 | Mustian | 423/316 |
| 3,507,614 | 4/1970 | Striplin et al. | 423/316 |
| 4,101,455 | 7/1978 | Francis et al. | 252/531 |
| 4,115,307 | 9/1978 | McGilvery | 252/135 |
| 4,116,852 | 9/1978 | Bailey et al. | 252/135 |
| 4,180,471 | 12/1979 | Schrödter et al. | 252/140 |

FOREIGN PATENT DOCUMENTS

| | | | |
|---|---|---|---|
| 941705 | 2/1974 | Canada | 252/135 |
| 1080722 | 4/1960 | Fed. Rep. of Germany | 252/135 |
| 1045691 | 10/1966 | United Kingdom . | |

*Primary Examiner*—P. E. Willis, Jr.
*Attorney, Agent, or Firm*—Connolly and Hutz

[57] ABSTRACT

The invention provides cleaning and detergent compositions containing about:

5 to 30 weight % of a surfactant and 10 to 30 weight % of a builder mixture consisting of alkali metal orthophosphate, alkali metal pyrophosphate, alkali metal tripolyphosphate and alkali metal melt phosphate, wherein the ratio by weight of the sum of orthophosphate, pyrophosphate and tripolyphosphate to melt phosphate is about 30:1 to 1:30, the ratio by weight of orthophosphate to pyrophosphate is about 10:1 to 1:10, and the ratio by weight of orthophosphate to tripolyphosphate is about 20:1 to 1:20, the balance being detergent auxiliaries and addends.

6 Claims, No Drawings

DETERGENT AND CLEANING COMPOSITIONS CONTAINING POLYMERIC PHOSPHATE BUILDERS

The present invention provides detergent and cleaning compositions containing surfactants, builders, detergent auxiliaries and addends, the builders comprising mixtures of certain condensed and uncondensed phosphate salts.

It has already been disclosed that the cleaning power of soaps and synthetic surfactants can be improved by means of certain addends, which are termed builders.

The mechanism and the details of the bilder effect have not yet been fully described so that it is substantially impossible to predict whether a particular compound is qualified for use as a builder.

In view of the many factors which all contribute to improving the cleaning power of surfactants, and in view of the most recent art in this field, it is necessary for a builder to meet the following requirements, namely:

(1) to sequester the hardness-inducing agents of the water, such as calcium and magnesium ions;

(2) to disperse pigment dirt particles, which are the principal constituents of the dirt of fabrics, in the wash-bath;

(3) to stabilize the dirt removed in the wash-bath and prevent dirt particles from redepositing on the fiber;

(4) to inactivate mineral matter being contained in the wash-bath; and (5) to reduce the adsorption of surfactant on the fiber.

To determine the quality and qualification of individual materials for use as a builder, it is good practice to test their behaviour and efficiency in washing or cleaning operations, to ensure the qualitative and quantitative determination of all factors that make their contribution to the builder effect.

Classical builders comprise water-soluble alkali metal salts of inorganic acids, such as alkali metal carbonates, borates, phosphates, polyphosphates, bicarbonates and silicates.

While a plurality of compounds have been suggested for use as builders, the fact remains that alkali metal polyphosphates are generally preferred as they meet all of the requirements set forth hereinabove and synergetically improve the cleaning efficiency, in combination with surfactants. This is the reason why they are used today as the principal constituent in detergents for heavy, fine and coloured fabrics. More particularly, pentasodium triphosphate is used. Detergents generally contain from 25–65%, and cleaning agents partially contain up to 90 weight% of said builder.

The considerably increased consumption of phosphatecontaining detergent and cleaning agents both for domestic and industrial purposes has also effected an increase in the phosphate content of natural waters. In studies of the eutrophication of waters, which has been found to occur at increasing rates, the water-soluble nitrate and phosphate salts have recently been held to have properties that are able under certain conditions to promote the growth of certain alga species, thereby to make their contribution to the eutrophication of water, and also to affect the oxygen demand of these waters considerably. Even though it is impossible for the time being definitely to clarify this problem, namely the contribution of phosphate-containing detergent and cleaning compositions to the eutrophication of water, it is highly desirable to have potential substitutes free from nitrogen and phosphorus for the builders that find wide-spread use in current detergent formulations, or to reduce the total phosphorus concentration in detergent formulations, by the use of alkali metal polyphosphates in combination with further suitable detergent components.

Various organic compounds have already been suggested for use as builders, e.g. nitrilotriacetic acid, ethylenediaminetetracetic acid, citric acid, oxydiacetic acid, oxydisuccinic acid, cyclocarboxylic acids or polymeric carboxylic acids, such as polymaleic acid and polyacrylic acid and their copolymers with unsaturated carboxylic acids, olefins or short chain unsaturated aliphatic ethers or alcohols.

These substances are, however, not fully satisfactory in respect of the following: They either have an extremely high power for complexing heavy metals and transition metals, whereby it is made possible for the heavy metals by the direct sequestration, or later during the remobilization, of the water sediment, to concentrate in surface water and thereby to find their way into drinking water, or they have unsatisfactory builder properties and accordingly produce unsatisfactory wash results. In addition to this, the art is partially in need of processes which would permit these compounds to be made under commercially attractive conditions.

It has long been known in the art that higher condensed linear polyphosphates with a degree of condensation higher than 3, especially those with 4 to 1000 $PO_3$-units, exhibit very good builder properties in cleaning operations.

These polyphosphates comprise the various Graham's salts, which were formely termed hexametaphosphates and which are termed melt phosphates hereinafter in accordance with the process used for making them. In German Patent Specification No. 747 770, it has more particularly been suggested that aqueous solutions of alkali metal metaphosphates, e.g. hexametaphosphate, should be used with or without alkali metal pyrophosphate and soaps as detergent, cleaning and rinsing agents. The use of condensed phosphates as builders in synthetic detergents has also been broadly discussed by H. Stüpel in "Seifen-Oele-Fette-Wachse" 79 (1953) 21, pages 537–539 and 79 (1953) 22, pages 570–574 and 79 (1953) 23, pages 592–593, respectively. The detergent formulations described by Stüpel actually contain melt phosphate together with alkali metal pyrophosphate or alkali metal tripolyphosphate, but they are definitely free from alkali metal orthophosphate. In other words, the art would appear to have been prejudiced against the use of metal phosphates jointly with orthophosphates in detergent compositions.

It has also been described in scientific publications more than in patent literature that pure Graham's salt is strongly hygroscopic and therefore stable to storage only if packed in special containers which are normally not used for reasons of economy for packing detergents for domestic uses. In the meantime, modified melt phosphate grades of reduced hygroscopicity, good flowability and stability to storage have been described. While these have long been used in cleaning operations and metered into the washing machine separately from the detergent, we are not aware of any successful prior attempt by the incorporation of melt phosphates, which are known for their good builder properties, to impart non-hygroscopic and non-coalescent properties to pulverulent, e.g. spray-dried universally applicable detergent compositions.

It is therefore an object of the present invention to provide ecologically more beneficial pulverulent detergent and cleaning compositions which combine in themselves stability to storage with flowability, reduced phosphate builder content and unimpaired cleaning power.

The present invention provides more specifically a detergent and cleaning composition comprising an anionic and/or cationic and/or amphoteric and/or ampholytic and/or non-ionic surfactant, one or more phosphate salts as builders and customary detergent auxiliaries and addends, the composition containing about:

5 to 30 weight% of a surfactant, and 10 to 30 weight% of a builder mixture consisting of alkali metal orthophosphate, alkali metal pyrophosphate, alkali metal tripolyphosphate and alkali metal melt phosphate, wherein the ratio by weight of the sum of orthophosphate, pyrophosphate and tripolyphosphate to melt phosphate is about 30:1 to 1:30, the ratio by weight of orthophosphate to pyrophosphate is about 10:1 to 1:10, and the ratio by weight of orthophosphate to tripolyphosphate is about 20:1 to 1:20, the balance being detergent auxiliaries and addends.

A preferred feature of the present invention provides for the detergent composition to contain 15 to 25 weight% of the present builder mixture, wherein the ratio by weight of the sum of orthophosphate, pyrophosphate and tripolyphosphate to melt phosphate is 10:1 to 1:10, the ratio by weight of orthophosphate to pyrophosphate is 5:1 to 1:2, and the ratio by weight of orthophosphate to tripolyphosphate is 10:1 to 1:10.

A practically proven detergent composition preferably contains, for example:

1–10 weight%, more preferably 3–8 weight%, of alkali metal orthophosphate, 0.5–3 weight%, more preferably 0.5–1 weight%, of alkali metal pyrophosphate, 1–20 weight%, more preferably 1–5 weight%, of alkali metal tripolyphosphate, and 1–25 weight%, more preferably 20–25 weight%, of melt phosphate.

It is basically necessary for the melt phosphate to have a degree of condensation higher than 3 and to contain 4–1000, preferably 4 to 200 $PO_3$-units in the molecule. This corresponds in the latter case to a $P_2O_5$-content of about 60 to 69.5 weight%.

The detergent and cleaning composition of the present invention contains as further constituents conventional surfactants, detergent aids and addends. The surfactants comprise more specifically, for example: dodecylbenzenesulfonate, hardened tallow soap and/or tallow fatty alcohol ethoxylated with 11 mols of ethylene oxide. The useful detergent aids and addends comprise, e.g. the alkali metal or ammonium salts of sulfuric acid, silicic acid, carbonic acid, boric acid, alkylenephosphonic acid, hydroxy-alkylene-phosphonic acid or aminoalkylenephosphonic acid, and bleaching agents, stabilizers for peroxide compounds and water-soluble organic complex formers. In addition to the builder mixture, the detergent and cleaning composition of the present invention may contain 1 to 20 weight% of zeolite grade A and 1 to 7 weight% of poly-α-hydroxyacrylic acid.

A further preferred feature of the present invention provides for the detergent composition to be made by a hot spray-drying process.

The following statements are intended further to describe the present detergent and cleaning composition.

In those cases in which it is desirable or necessary, it is possible for the detergent composition to be used in admixture with a strongly alkaline salt so that the detergent composition presents a pH-value of 9 to 11 in water.

The anionic surfactants comprise the water-soluble salts of higher fatty acids or resinic acid, such as sodium or potassium soaps of hardened or non-hardened coco palm-kernel oil or beet oil, or of tallow and suitable blends thereof. The anion-active substances used in the present invention also include higher alkyl-substituted, mono-nuclear, aromatic sulfonates, such as alkylbenzenesulfonates having from 9–14 carbon atoms in the alkyl radical, alkylnaphthalenesulfonates, alkyltoluenesulfonates, alkylxylenesulfonates or alkylphenolsulfonates as well as sulfated aliphatic alcohols or alcohol ethers, such as sodium or potassium lauryl or hexadecylsulfate, triethanolaminelaurylsulfate, sodium or potassium oleylsulfate, and sodium or potassium salts of laurylsulfate ethoxylated with about 2 to 6 mols of ethylene oxide. Further suitable anionic surfactants are secondary linear alkanesulfonates and α-olefinsulfonates having a chain length of 12 to 20 carbon atoms.

The non-ionic surfactants usable in accordance with the present invention are compounds which present an organic hydrophobic group and a hydrophilic radical. Exemplary representatives of these non-ionic surfactants are the condensation products of alkylphenols with ethylene oxide or of higher fatty alcohols with ethylene oxide, the condensation products of polypropyleneglycol with ethylene oxide or propylene oxide, and the condensation products of ethylene oxide with the reaction product of ethylenediamine and propylene oxide. The above compounds also include long-chain tertiary amine oxides.

The surfactant ingredients of the detergent and cleaning compositions of the present invention finally include ampholytic and amphoteric materials, for example derivatives of aliphatic, secondary or tertiary amines or quaternary ammonium compounds having from 8 to 18 carbon atoms and a hydrophilic group in the aliphatic radical, e.g. sodium-3-dodecylaminopropionate; sodium-3-dodecylaminopropanesulfonate; 3-(N,N-dimethyl-N-hexadecylamino)-propane-1-sulfonate or fatty acid aminoalkyl-N,N-dimethylacetobetain, the fatty acid containing between 8 and 18 carbon atoms and the alkyl radical containing 3 carbon atoms.

Further detergent aids or addends, which may be used in accordance with the present invention, include, for example: sodium perborate monohydrate or tetrahydrate, alkali metal salts of peroxymono- or disulfuric acid, alkali metal salts of perpyrophosphoric acid, water-soluble precipitated magnesium silicate, and alkali metal salts of iminodiacetic acid, nitrilotriacetic acid, ethylenediaminetetracetic acid, methylenediphosphonic acid, hydroxyethanediphosphonic acid and nitrilotris-methylenephosphonic acid.

Still further ingredients of the detergent and cleaning compositions include substances improving the capacity of washing liquors for suspending or peptizing dirt, such as carboxymethylcellulose, polyvinyl alcohol, polyvinylpyrolidone, or foam regulators, such as mono- and dialkylphosphoric acid esters containing between 16 and 20 carbon atoms in the alkyl radical, as well as optical brighteners, disinfectants and/or proteolytic enzymes.

Very useful detergent aids or addends, which can be used in combination with the further ingredients of the detergent and cleaning compositions and contribute to improving the washing efficiency, are magnesium silicate, sodium silicate, sodium perborate tetrahydrate, sodium sulfate or carboxymethylcellulose.

The detergent and cleaning composition of this invention can reasonably be said to compare favorably with the detergent formulations described heretofore, in respect of the following: Despite its reduced phosphate content, it has a cleaning power as high as that of the prior art products. In addition to this, it contributes to providing a solution for the eutrophication problem. These beneficial effects are exclusively a result of the particular composition selected for the builder mixture forming part of the present detergent and cleaning composition.

The following Examples illustrate the invention which is, however, not limited thereto. The parts and percentages indicated in the Examples are by weight and the quantities of the individual ingredients are referred to the anhydrous product unless expressly stated otherwise.

EXAMPLE 1

A pulverulent detergent composition (product 1) was prepared by spray-drying. The product had the following nominal composition, in weight%:

| | |
|---|---|
| Dodecylbenzenesulfonate | 9.0 |
| Tallow fatty alcohol ethoxylated with 11 mols of ethylene oxide per mol of alcohol | 3.0 |
| Tallow fatty soap | 3.0 |
| Melt phosphate (about 68% $P_2O_5$) | 20.0 |
| Sodium orthophosphate | 5.0 |
| Magnesium silicate | 3.0 |
| Sodium silicate | 3.0 |
| Sodium perborate . 4 $H_2O$ | 22.0 |
| Carboxymethylcellulose | 1.0 |
| Ethylenediaminetetracetic acid | 0.2 |
| Optical brighteners, aids | 0.5 |
| Sodium sulfate | 25.0, |
| the balance being water. | |

Under the conditions of the hot spray process, it was impossible to avoid partial hydrolytic degradation of the melt phosphate so that the final detergent formulation actually contained the following proportions of phosphate: about 17 weight% of melt phosphate, 2.2 weight% of tripolyphosphate, 0.6 weight% of pyrophosphate and 5.2 weight% of orthophosphate. The product combined in itself a good flowability with good pourability and stability to storage, packed in customary containers. The product (1) contained altogether 7 weight% of phosphorus.

A comparable product (2) was prepared under the conditions described above with reference to product (1). As compared with product (1), product (2) contained, as the builder, 35.5 weight% of sodium tripolyphosphate. To incorporate into product (2) the increased quantity of phosphate (increased with respect to the phosphate content of product (1)), it was necessary to reduce the proportion of sulfate. The final spray-dried product contained about 30 weight% of sodium tripolyphosphate, 3.7 weight% of sodium pyrophosphate and 0.8 weight% of sodium orthophosphate. As to its ingredients, the comparable product (2) corresponded to commercial quality detergent compositions. The comparable product (2) contained altogether 9 weight% of phosphorus.

The cleaning power of product (1) was compared with the cleaning power of product (2). To this end, tests were made to determine the primary cleaning power of the two products.

The wash tests were made on standard cotton fabrics soiled with "Krefeld" dirt in a "Launder-O-meter" at a wash bath temperature of 95° C. Standard fabrics soiled with Krefeld dirt have been defined by Kurt Lindner in the book entitled: "Tenside, Textilhilfsmittel-Waschrohstoffe", Wissenschaftl. Verlagsgesellschaft Stuttgart (1964), volume II, page 1837.

The wash water had a hardness of 18° (German degrees of hardness) and a pH of 10, which was established by the addition of sodium hydroxide solution to the wash liquor. The wash period was 30 minutes and the bath ratio, expressed by the ratio of material to be washed in kg to wash liquor in liters was 1:25, and the wash operation was carried out in the presence of 10 steel balls.

After the prescribed wash time, the standard cotton fabric was rinsed, once hot and once cold, with water of identical hardness, and its degree of witheness was then determined at 530 mμ using a colorimeter RFC 3 (a product of Zeiss). Based on the test result, the cleaning power of the wash liquor was calculated according to the following formula:

$$\%WK = \%WG_g - \%WG_b$$

in which

% WK = % cleaning power

% $WG_g$ = % whiteness of washed fabric

% $WG_b$ = % whiteness of unwashed fabric.

The two detergent compositions tested, of which none could be found to distinguish favorably over the other, had a statistic average cleaning power of 37%. It was inferred from this that the surfactant and phosphate constituents of product (1) (invention) and the surfactant and tripolyphosphate constituents of prior art product (2) produced the same synergetic effect during the wash operation.

A further test series was made to determine the content of inorganic ash which had deposited on the test fabric with the use of products (1) and (2), respectively, after 25 wash operations.

To this end, products (1) and (2), respectively, were used in commercial domestic washing machines which were operated with water with a hardness of 3° (German degrees of hardness). The detergent compositions were used in the quantities suggested for water of 3° hardness. Placed in the washing machine were 3 kg of anonymously soiled household fabrics and 1.5 kg of a cotton test fabric of the "Eidgenössischen-Material-Prüungs-Anstalt" (Swiss-Material-Testing-Institute). Full wash programs were effected.

After 25 wash operations, solid matter, expressed as inorganic ash, was found to have been deposited on the fabric:

Test product (1): 0.7 weight%

Test product (2): 0.6 weight%

In this test series again, product (1) was found qualitatively equal to product (2). As can be seen, product (1)

and product (2) produced substantially identical wash results. Under the aspect of economy and anti-pollution, however, product (1) with its lower phosphorus content of 7 weight% can be said to compare favorably with product (2) which contained 9 weight% of phosphorus.

EXAMPLE 2

A pulverulent detergent composition (product 3) which had the composition described in Example 1 was prepared, however, with the use of only 15 weight% of melt phosphate. This naturally gave a product (3) which contained less phosphate than the product of Example 1, but in which the $Na_2SO_4$-content was increased to 30 weight%. Product (3) contained altogether 5.5 weight% of phosphorus.

For the purpose of comparison, a further detergent agent of customary composition (product 4) which also contained altogether 5.5 weight% of phosphorus was made. Product (4) differed from product (3) with respect to its phosphate component which was 21.7 weight% of sodium tripolyphosphate. The $Na_2SO_4$-content was 28.3 weight%.

The wash tests were effected as in Example 1. Product (3) had a cleaning power of 35% and product (4) had a cleaning power of 34%.

3% of inorganic ash was found to have been deposited on the fabric washed with product (3) and 7% of inorganic ash was found to have been deposited on the fabric washed with product (4).

EXAMPLE 3

The procedure was as described in Example 1, but a detergent composition (Product 5) containing 15 weight% of melt phosphate and 5 weight% of sodium orthophosphate was prepared. In addition to this, 20 weight% of zeolite grade A was used in product (5) in which the $Na_2SO_4$-content was reduced to 10 weight%. 37% was the cleaning power determined for product 5 in the wash test and 1.5% was the value determined in the fabric ash test after 25 wash operations.

EXAMPLE 4

The procedure was as in Example 1, but a detergent composition (product 6) was made in which the zeolite grade A was replaced by 5 weight% of poly-α-hydroxyacrylic acid. The $Na_2SO_4$-content was 25 weight%. 37% was the cleaning power determined for product (6) and 0.5% was the value determined in the fabric ash test.

EXAMPLE 5

The procedure was as in Example 1, but a detergent composition (product 7) which contained 25 weight% of melt phosphate, 7.5 weight% of sodium orthophosphate and 17.4 weight% of $Na_2SO_4$ was made. Product (7) contained altogether 9% of phosphorus. A value smaller than 0.5% was determined in the fabric ash test.

We claim:

1. Detergent and cleaning composition containing about 5 to 30 weight % of a surfactant selected from the group consisting of anionic, nonionic, ampholytic and amphoteric detergents 3 to 8 weight % of alkali metal orthophosphate, 0.5 to 1 weight % of alkali metal pyrophosphate, 1 to 5 weight % of alkali metal tripolyphosphate, and 20 to 25 weight % of a phosphate having a degree of condensation higher than 3 and containing 4 to 1000 $PO_3$ units in the molecule as builder mixture, the balance being detergent auxiliaries and addends comprising alkali metal or ammonium salts of sulfuric acid, silicic acid, carbonic acid, boric acid, bleaching agents, stabilizers for peroxide compounds and water soluble organic complex formers.

2. Composition as claimed in claim 1, containing 15 to 25 weight% of the builder mixture.

3. Composition as claimed in claim 1, wherein the phosphate having a degree of condensation higher than 3 contains 4 to 200 $PO_3$ units in the molecule, corresponding to a $P_2O_5$ content of about 60 to 69.5 weight %.

4. Composition as claimed in claim 1, containing, as the surfactant, dodecylbenzenesulfonate, hardened tallow soap and/or tallow fatty alcohol ethoxylated with 11 mols of ethylene oxide.

5. Composition as claimed in claim 1, containing the builder mixture together with a 1 to 20 weight% proportion of zeolite grade A or a 1 to 7 weight% proportion of poly-α-hydroxyacrylic acid.

6. Composition as claimed in claim 1 prepared by hot spray-drying.

* * * * *